US010401021B2

(12) United States Patent
Gary et al.

(10) Patent No.: US 10,401,021 B2
(45) Date of Patent: Sep. 3, 2019

(54) APPARATUS FOR ATTACHING ILLUMINATORS TO HAND HELD DEVICES

(71) Applicants: Derek Dwayne Gary, Memphis, TN (US); Derrick Wilfred Charbonnet, Ocean Springs, MS (US)

(72) Inventors: Derek Dwayne Gary, Memphis, TN (US); Derrick Wilfred Charbonnet, Ocean Springs, MS (US)

( * ) Notice: Subject to any disclaimer, the term of this patent is extended or adjusted under 35 U.S.C. 154(b) by 281 days.

(21) Appl. No.: 15/147,036

(22) Filed: May 5, 2016

(65) Prior Publication Data

US 2017/0023234 A1 Jan. 26, 2017

Related U.S. Application Data

(60) Provisional application No. 62/166,892, filed on May 27, 2015.

(51) Int. Cl.
*F21L 4/00* (2006.01)
*F21V 33/00* (2006.01)
*F41G 1/35* (2006.01)

(52) U.S. Cl.
CPC ..... *F21V 33/0084* (2013.01); *F41G 1/35* (2013.01)

(58) Field of Classification Search
CPC ..... F21V 33/008; F41G 1/35
USPC ..... 362/110–114, 119, 120
See application file for complete search history.

(56) References Cited

U.S. PATENT DOCUMENTS 8,186,859 B2 * 5/2012 Shih ..... B25B 9/02 294/99.1
2006/0256547 A1 * 11/2006 Huang ..... B25B 23/18 362/119
2012/0033405 A1 * 2/2012 Oomori ..... B25B 23/18 362/89
2012/0124885 A1 * 5/2012 Caulk ..... F41G 1/35 42/146
2013/0223045 A1 * 8/2013 Cammenga ..... B26B 11/008 362/119
2013/0235562 A1 * 9/2013 Chauvie ..... F41G 1/35 362/110
2014/0063791 A1 * 3/2014 Frazier ..... F21L 4/00 362/110
2014/0150323 A1 * 6/2014 Kowalczyk, Jr. ..... G01B 11/27 42/115
2016/0032612 A1 * 2/2016 Huang ..... E04H 15/10 362/120

* cited by examiner

*Primary Examiner* — Jong-Suk (James) Lee
*Assistant Examiner* — Eric T Eide

(57) ABSTRACT

An apparatus wherein an illuminator is attached to the grip of small tactical weapons or tools. This apparatus comprises the illuminator that is integrally mounted to the weapon grip and a stem that moves the illuminator face forward between two fingers. In the case of a revolver, the grip would extend between the middle finger and ring finger in one embodiment. It extend forward far enough so that the light could clearly illuminate the target without obstruction by the fingers. The same could be done with the grip of a knife or club.

13 Claims, 8 Drawing Sheets

APPARATUS FOR ATTACHING ILLUMINATORS TO HAND HELD DEVICES

CROSS REFERENCE TO RELATED PATENTS

U.S. Pat. No. 5,237,773 Integral Laser Sight, Switch for a Gun
U.S. Pat. No. 5,485,695 Laser Aiming Device
U.S. Pat. No. 5,628,555 Switch Actuation Mechanism for a Firearm-Mounted Flashlight
U.S. Pat. No. 7,303,306 Multi-Purpose Flashlight Device and Method of Using Same
U.S. Pat. No. 7,421,818 Firearm Mount with Embedded Laser Sight
U.S. Pat. No. 7,676,975 Tactical Foregrip Assembly
U.S. Pat. No. 8,256,154 Laser Gunsight System for a Firearm Trigger Guard
U.S. Pat. No. 8,387,294 Handgun Identification Light
U.S. Pat. No. 8,529,083 Multi-Directional Firearm Light
U.S. Pat. No. 8,662,694 Illumination Device and Method
2012/0033405 Power Tool
2012/0124885 Modular Sighting and Lighting System for Handguns
2013/0235562 Handgun Illumination Device
2014/0063791 Tactical Flashlight and Accessory

BACKGROUND

Ever since humans wielded weapons, there was the need for light to see what may lay in the darkness before us. Traditionally this was a flaming torch or, later, a lantern. Modern times provided electric flashlights. These are bulky and require the use of the other hand.

More recently technology has provided very tiny bulbs such as light emitting diodes (LEDs). LEDs can come in broad, flashlight type styles and in types that emit lasers. Normal LEDs and Laser LEDs are both well known in the art as compact and bright light sources. LEDs of both types have been conveniently and comfortably fitted many ways on all kinds of weapons. There are notable exceptions: two examples are the single handed close weapon (knife or club) and the revolver. Neither of these have a convenient place to mount or hang a light.

This invention provides a place for a light on those weapons.

BRIEF DESCRIPTION OF THE ILLUSTRATIONS

FIG. 1 is a side view of a typical revolver. The front face of the grip (2) is facing left. One embodiment of the illuminator mount and stem (1) is clearly seen protruding forward from the grip and holding the illuminator (3) at its end. Two embodiments of the on/off switch (4) are marked.

Figure 5:
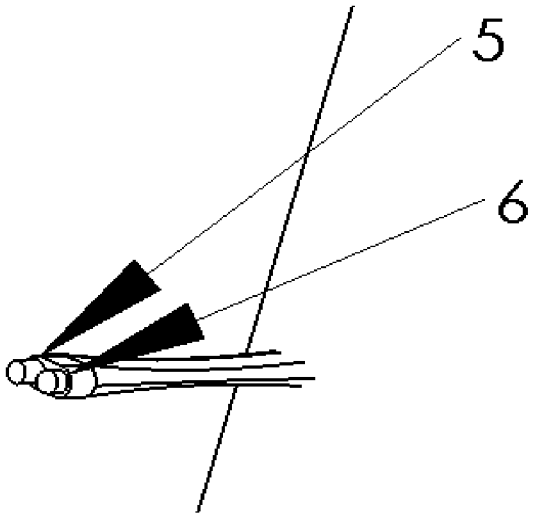

FIG. 5 displays two embodiments of the illuminators. An LED (5) and an incandescent (6) bulb, both housed on a single mount and stem. One edge of the grip can be seen.

Figure 6A:
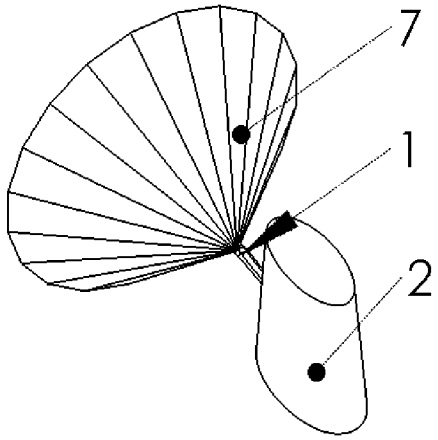
Figure 6B:
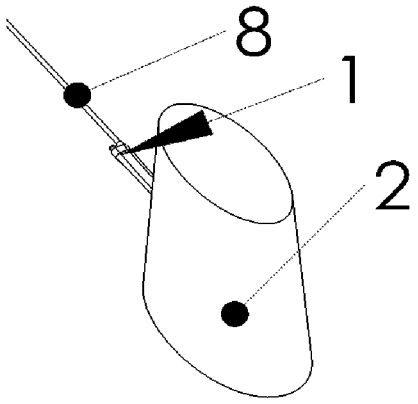

FIG. 6 displays two embodiments of illumination patterns from the illuminators housed on a single mount and stem (1), the grip (2) is shown as a generic shape for simplicity. FIG. 6*a* shows a wide or flood-light pattern (7). FIG. 6*b* shows a very narrow light pattern (8) such as a laser beam.

Figure 7A:
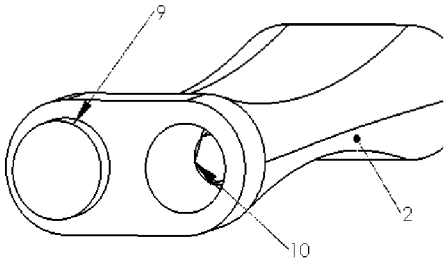
Figure 7B:
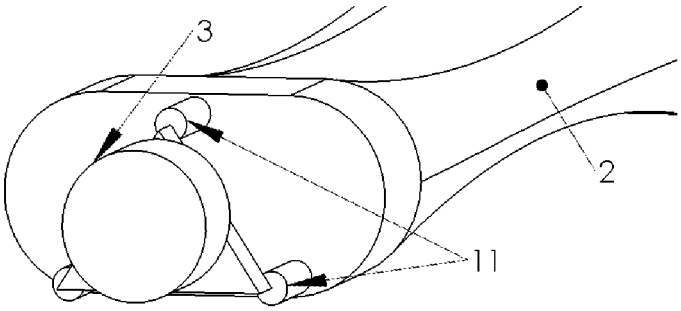

FIG. 7 shows the face of the mount and stem with three embodiments of light mounts. 7*a* shows fixed bulbs mounted on the face of the stem (9) and recessed (10). FIG. 7*b* shows a bulb (3) mounted on an a plate held to the face of the stem with three adjustable length struts (11) allowing the center-line of the emitted light pattern to be moved at an angle relative to the center-line of the weapon. The grip is in the background but is not shown.

Figure 8:
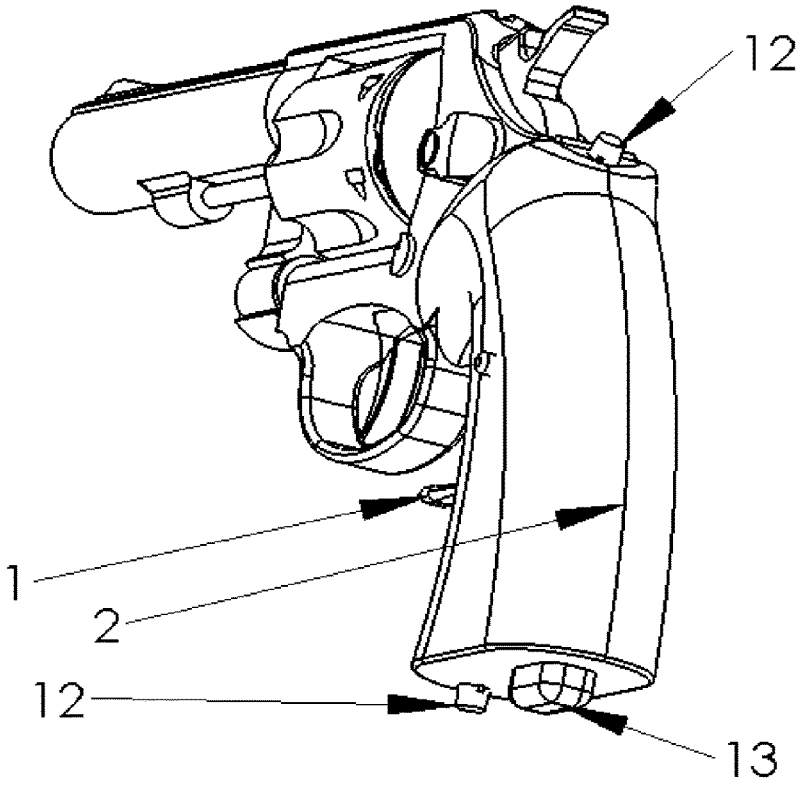

FIG. 8 contains two embodiments of adjustment knobs (12) for the gain of the illumination and one embodiment of a power supply that is external to the grip (2). Another embodiment of a power supply would be entirely contained within the grip and, thus, is not shown.

DETAILED DESCRIPTION

This very simple invention provides a way to shine illumination with the same hand that holds a weapon or tool. This invention is important for weapons or tools where the well understood ways to attach a light are not practical.

There are various ways of attaching illumination to a weapon, well understood in the art, in which the illumination device is attached alongside or under the barrel. However, on tools or weapons such a revolver, where the body and grip of the weapon is compact, there is simply no room.

The illumination device in this apparatus is attached directly to the grip (2). To overcome the problem of the illumination device being covered by the fingers, this apparatus includes a small "stem" (1) extending from the mount on the grip forward (relative to the normal use of the tool or weapon). It passes between two fingers and extends far enough forward to allow the illumination source to clear the users fingers.

In one embodiment on a hand gun, the stem will generally point in the same direction as the barrel. The user can use the illuminators (3)(5)(6)(7) to brighten the area in front of the weapon making the potential target easier to see. A second embodiment incorporates an LED laser illumination source (8) as an aiming aid.

In the embodiment shown in all of the figures with the exception of 7*b*, the stem is shown with two illumination sources, there can be one or many. The shape of the light emitted from the illuminators can be chosen depending on the needs of the users. Two embodiments are shown in FIG. 6. a wide or flood-light 6*a* and a narrow or coherent beam 6*b*. The wavelength of the illumination (not shown in the black and white figures) can be selected depending on the needs of the user.

Figure 1:
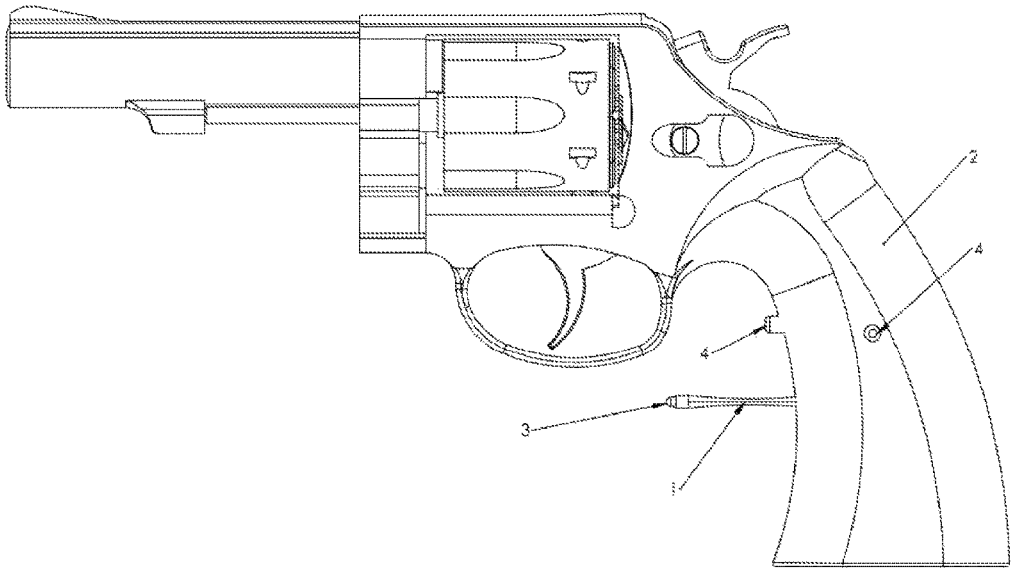
Figure 2:
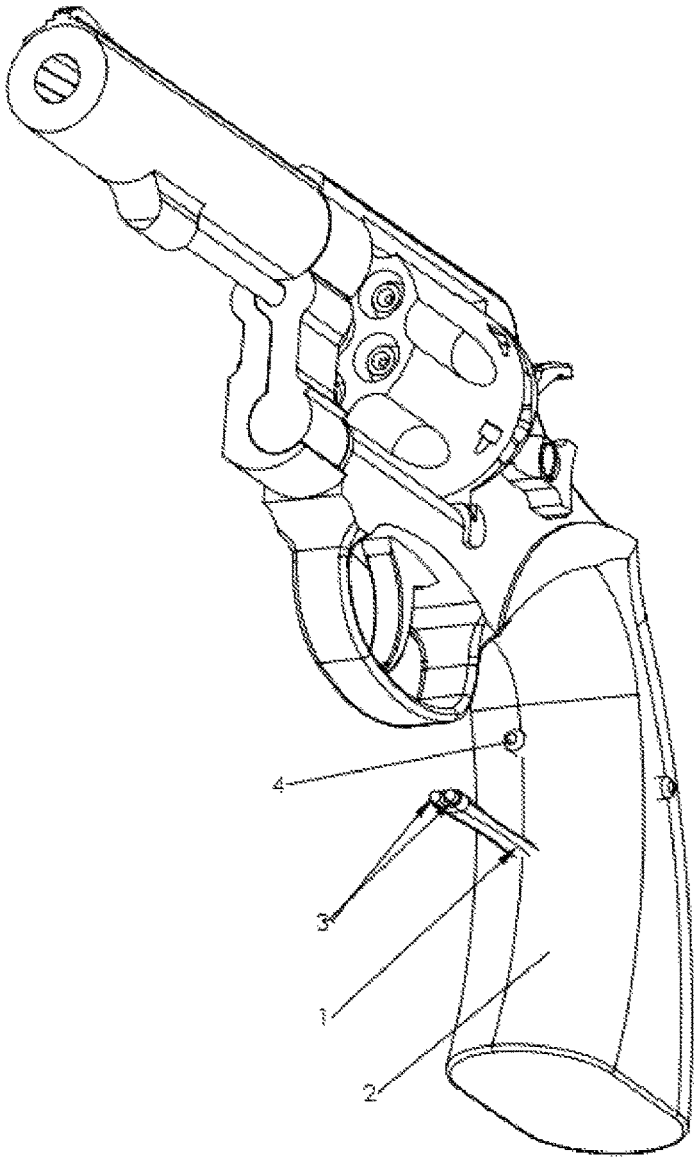
FIG. 2 is the same as FIG. 1 but shown from a front oblique view for clarity.
Figure 3:
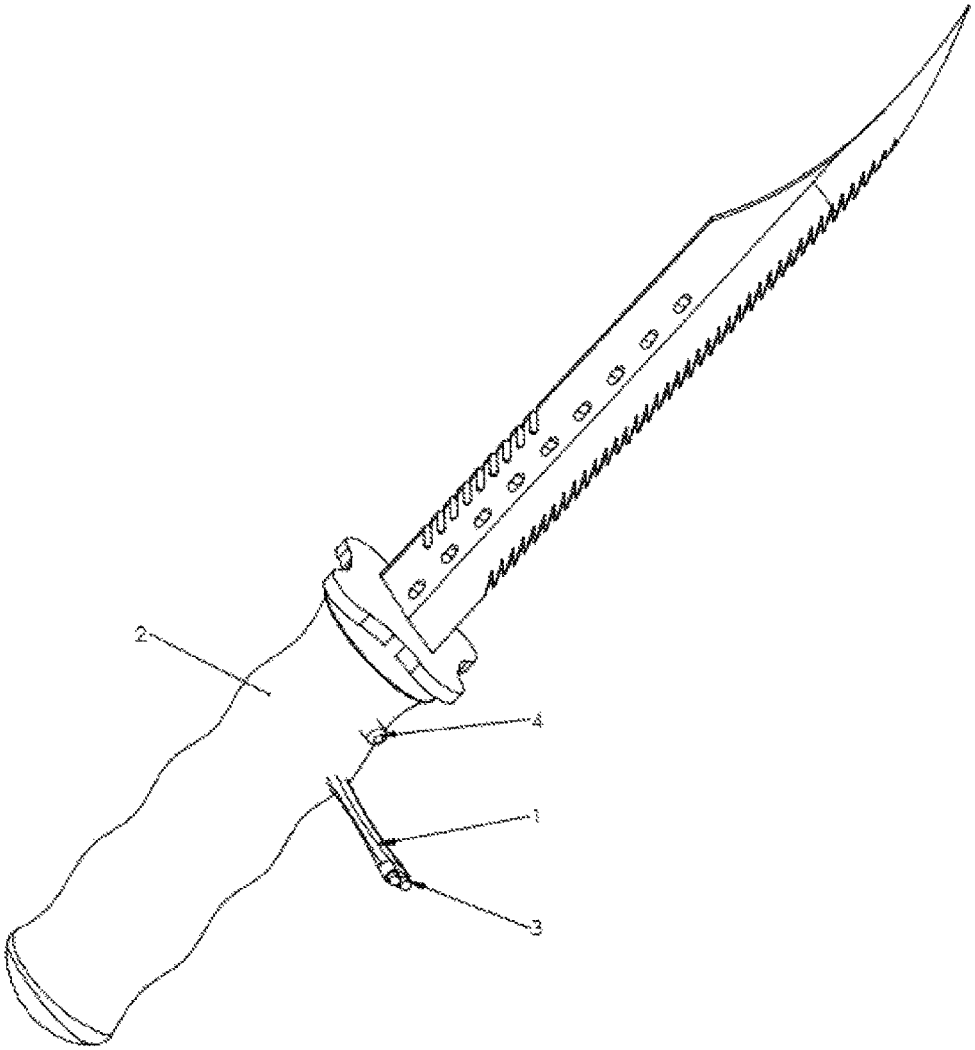
FIG. 3 is another embodiment installed on a "survival style" knife.
Figure 4:
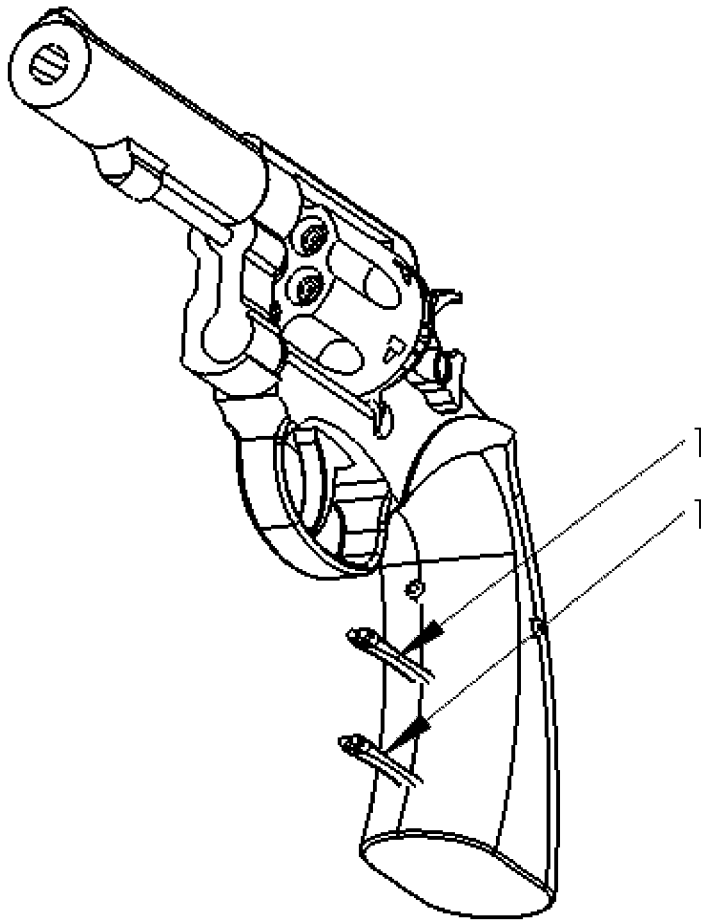
FIG. 4 is an embodiment with two mounts (1), two stems, and a plurality of illuminators.

The illumination would be activated by a plurality of switches (4) on the grip or weapon. The location of the switches would allow the user the easiest means to activate the sources while holding the tool or weapon at the ready. Two embodiments are shown in FIGS. 1 & 2.

The illuminators could be fixed to the stem (9) (10). Of particular interest for firearms would to have one of these plurality of illumination sources as a laser. The laser would be aimed in the same direction at the barrel to assist in the aiming of the weapon. An adjustable mount (11) shown in FIG. 7*b* would allow fine alignment of the laser and the bore of the weapon based on the distance to the target and the users preference.

The illumination sources could be switched on/off or its intensity changed by a plurality of switches (4) or knobs (12) on the grip. A convenient embodiment would have one switch built into the grip under one of the fingers. This would allow the user to turn the light on and off simply squeezing a finger.

The power would be supplied by batteries (or other power source), enclosed in the grip in the preferred embodiment or attached to the outside of the grip (13). The power supply inside the grip is not shown in the figures as it cannot be seen.

What is claimed is:

1. An illumination device comprising:

a plurality of light sources (3) mounted on the grip (3) of a weapon or tool, a mount for the plurality of light sources on the area of the grip which is on the generally forward facing section of the grip normally covered by the fingers during operation, a single stem (1) comprising a near end and a far end, the near end protruding out of the grip, the far end having the plurality of illumination sources, the far end being only connected to the tool or weapon via the near end, and the stem passing between and beyond two fingers of the user gripping the grip of the tool or weapon.

2. The illumination device of claim 1, wherein the stem allows the light from the sources to project from the tool or weapon from the area of the grip that is normally covered by the fingers.

3. The illumination device of claim 1, wherein the light is pointed in the same direction as the weapon or tool to provide illumination to facilitate its use.

4. The illumination device of claim 1, wherein there is a plurality of single stems on a single grip passing between different pairs of fingers.

5. The illumination device of claim 1, wherein the plurality of light sources comprises incandescent lights (5), light emitting diodes (LED) (6), or other devices that emit photons or energy.

6. The illumination device of claim 1, wherein the plurality of light sources projects photons or energy in a plurality of beam widths ranging from wide spread flood light (7) to a coherent beam laser (8).

7. The illumination device of claim 1, wherein the plurality of light sources project photons or energy in a plurality of frequencies on the electromagnetic spectrum.

8. The illumination device of claim 1, wherein the plurality of light sources are set in the stem in a fixed position (9) (10), or in an adjustable way (11) such that the center-line of the illumination can be precisely adjusted in reference to the center-line of the weapon on which it is mounted.

9. The illumination device of claim 1, wherein the plurality of light sources are activated by a plurality of switches (4) located in a plurality of locations on the grip, and activated by pressing with a finger.

10. The illumination device of claim 1, wherein the gain of the energy emitted by the plurality of light sources can be adjusted by the user (12).

11. The illumination device of claim 1, wherein the power for the energy emission comes from power supplies co-located on the weapon or tool entirely within the grip, or within extensions of the grip (13).

12. The illumination device of claim 1, wherein the stem is flexible allowing the user to point the end of the stem in any direction desired.

13. The illumination device of claim 1, wherein the stem is hollow running lengthwise from the grip to the illuminator to provide space for the electrical connection, or the stem has wires traveling on the outside of the stem in order to provide an electrical connection for the plurality of light sources.

* * * * *